US009712904B1

(12) United States Patent
Harden

(10) Patent No.: US 9,712,904 B1
(45) Date of Patent: Jul. 18, 2017

(54) MULTI-MODE MICROPHONE

(71) Applicant: Kenneth Harden, Eden Prairie, MN (US)

(72) Inventor: Kenneth Harden, Eden Prairie, MN (US)

(73) Assignee: BBY SOLUTIONS, INC., Richfield, MN (US)

( * ) Notice: Subject to any disclaimer, the term of this patent is extended or adjusted under 35 U.S.C. 154(b) by 0 days.

(21) Appl. No.: 15/083,679

(22) Filed: Mar. 29, 2016

(51) Int. Cl.

| | |
|---|---|
| ***H04R 11/04*** | (2006.01) |
| ***H04R 1/08*** | (2006.01) |
| ***H04R 1/04*** | (2006.01) |
| ***H04R 5/027*** | (2006.01) |

(52) U.S. Cl.
CPC ..... *H04R 1/08* (2013.01); *H04R 1/04* (2013.01); *H04R 5/027* (2013.01); *H04R 2201/025* (2013.01)

(58) Field of Classification Search
CPC .. H04N 5/772; H04N 5/2251; H04N 13/0044; H04N 13/0055; H04N 13/0059; H04N 13/0221; H04N 13/0239; H04N 13/0275; H04N 13/0285; H04N 13/0296; H04N 13/044; H04R 1/02; H04R 25/00; H04R 9/08; H04R 3/00
USPC ..... 381/365, 174, 36, 366, 386, 368; 181/158, 184; 379/430, 433.01; D14/225, 228, 226; D24/150, 172
See application file for complete search history.

(56) References Cited

U.S. PATENT DOCUMENTS

| | | | | | |
|---|---|---|---|---|---|
| 4,550,343 | A * | 10/1985 | Nakatani | G11B 31/006 | 348/335 |
| D331,936 | S * | 12/1992 | Ishikawa | D16/202 | |
| 5,220,369 | A * | 6/1993 | Sasaki | H01M 2/1022 | 348/372 |
| 5,535,281 | A * | 7/1996 | Gulick | H01L 27/0207 | 381/122 |
| 5,633,935 | A * | 5/1997 | Kanamori | H04R 3/005 | 381/26 |
| D431,817 | S * | 10/2000 | Yuyama | D14/227 | |
| D719,140 | S * | 12/2014 | Sanhui | D14/225 | |
| 2006/0221177 | A1* | 10/2006 | Chu | H04R 27/00 | 348/14.12 |
| 2007/0259594 | A1* | 11/2007 | Galbiati | A63H 5/00 | 446/15 |

(Continued)

*Primary Examiner* — Md S Elahee
*Assistant Examiner* — Julie X Dang
(74) *Attorney, Agent, or Firm* — Tysver Beck Evans, PLLC

(57) ABSTRACT

A multi-mode microphone assembly includes a mono microphone, a stereo microphone, and a rotary switch contained within a housing. The mono microphone has a mono input/output mode and the stereo microphone has a stereo input/output mode. Only one input/output mode is active depending on the position of the rotary switch within the housing. When the rotary switch is in a first position only the mono input/output mode is activated and when the rotary switch is in a second position the mono input/output mode is deactivated and the stereo input/output mode is activated. The first position of the rotary switch corresponds to a first position of the housing. The second position of the rotary switch corresponds to a second position of the housing. The first and second positions of the housing are offset 180 degrees from one another.

11 Claims, 7 Drawing Sheets

(56) References Cited

U.S. PATENT DOCUMENTS

| | | | | |
|---|---|---|---|---|
| 2010/0135506 | A1* | 6/2010 | Rosen | H01M 2/1055 381/91 |
| 2011/0069842 | A1* | 3/2011 | Akino | H04R 5/027 381/26 |
| 2012/0257078 | A1* | 10/2012 | Toishita | G06F 3/04847 348/222.1 |
| 2013/0063554 | A1* | 3/2013 | Green | H04N 5/2252 348/36 |

* cited by examiner 72
70
10
22
20
12
18
16

45
24
72
47
70
22
20
46
18
10
30
50
12
40
16
44

MULTI-MODE MICROPHONE

FIELD OF THE INVENTION

Embodiments of the disclosure are directed to microphones and more particularly to a multifunction microphone capable of capturing sound in either a mono or stereo mode.

SUMMARY

The two most common types of microphones, particularly for use in conjunction with a video camera, are mono- or shotgun microphones- and stereo microphones. If a videographer wishes to have both types of microphones at his or her disposal one of each type of microphone must be purchased. When used, each microphone must be individually connected to the video camera, with each microphone being switched out and reconnected to the video camera as needed depending on the acoustical requirements of the subject being filmed/recorded.

Embodiments of the disclosure described herein provide a single multi-mode mono/stereo hybrid microphone that can be readily switched between mono and stereo modes, without requiring the microphone to be removed or replaced depending on acoustic need. A single multi-mode microphone as disclosed herein provides a more efficient and cost effective solution to the current practice of requiring a user to have multiple microphones available for use.

DETAILED DESCRIPTION

Figure 1:
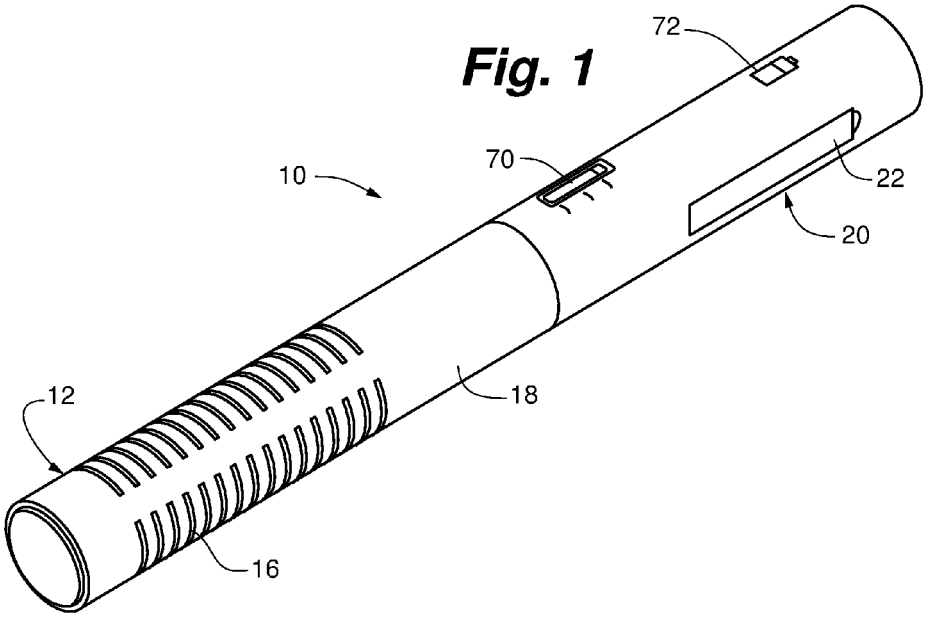
FIG. 1 is a perspective view of an embodiment of a multi-mode microphone.

In the various FIGS. 1-9 embodiments of the invention are shown. With specific regard to FIGS. 1-5, a multi-mode microphone assembly 10 is shown. Assembly 10 includes both a mono or "shotgun" microphone 12 and a stereo microphone or microphone array 20.

Mono microphone 12 may be any configuration of shotgun or rifle style microphones known also as interference tube microphones. Such microphones typically employ a directional capsule, such as a cardioid, supercardioid, hypercardioid, etc. (not shown) with a hollow slotted interference tube 16 to primarily detect on-axis sound (discussed in greater detail below in regard to FIG. 8).

Tube 16 also functions as the housing 18 within which the microphones 12 and 20 and their associated electronics (not show) are contained. While the housing 18 is a cylindrical tube in the embodiments shown and described herein, one of ordinary skill will recognize that the size and shape of the housing 18, or regions of the housing 18 may be variable.

As indicated, array 10 also includes a stereo microphone or microphone array 20. Stereo microphone 20 may comprise a first and second inputs (left and right microphones) 22 and 24 so as to be capable of picking up sound from two general directions (i.e. stereo sound) and outputting the detected sound as left and right signals or channels. Recording sound in stereo is often considered a superior recording mode for capturing ambient sound or off-axis sound occurring more broadly around the microphone (discussed in greater detail below in regard to FIG. 9).

In some embodiments, an example of which is shown in FIG. 1, inputs 22 and 24 are contained within the housing 18, so as to maintain the cylindrical profile of the tube 16 and provide improved protection to the inputs. Alternatively, inputs 22 and 24 are variably contained within the housing 18 or protrude externally thereto, such as in the manner shown in FIG. 2. In the embodiment shown the inputs 22 and 24 may be manipulated and repositioned by a user to customize the directional characteristics of the inputs. Inputs 22 and 24 can be of any configuration or size desired and may be of the same diameter as that of the tube 16 or be of a larger or smaller profile than that shown.

Figure 3A:
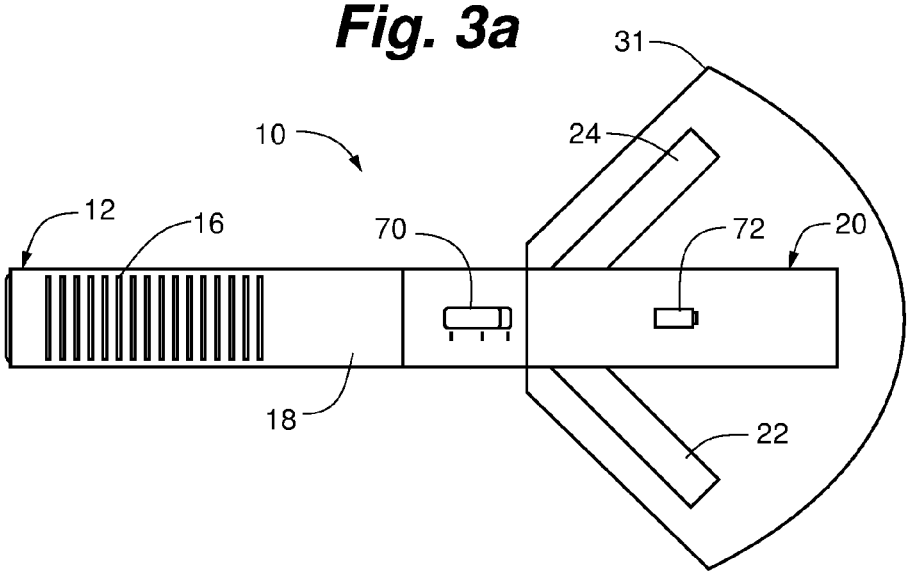
FIG. 3*a* is a top down view of the embodiment shown in FIG. 2 wherein an optional protective cowling is provided to the stereo microphone.

In at least one embodiment shown in FIG. 3*a*, the housing 18 is provided with an external cowling or enclosure 31, which is acoustically transparent but which surrounds the stereo microphone 20, including inputs 22 and 24, so as to provide additional protection to the inputs when they are externally deployed from the housing tube 16. Enclosure 31 is engaged to the tube 16 when in use but may be readily removed therefrom as desired.

It should be noted that while it may desirable to provide high quality microphones 12 and 20 to the assembly 10, and to ensure that the various electronics and interfaces needed to ensure that they perform their functions is likewise sufficient, the particular quality and construction of the microphones 12 and 20 may be varied. For purposes of this disclosure it is merely required that the microphone 12 be of a first or mono style microphone (capable of detecting and inputting sound and outputting sound on a single channel) and that the microphone 20 be configured as a stereo microphone (capable of detecting and inputting sound and outputting sound on two channels) and that each microphone is outputting detected sound electronically in accordance with the respective mode of the microphones 12 and 20.

One of ordinary skill in the art will recognize and understand the uses, limitations and advantages of a mono "shotgun style" microphone 12 and a stereo microphone 20; and when to employ one or the other for detecting and recording sound. To that end, embodiments of the microphone assembly 10 also include a mechanism for "switching" between the mono input/output mode shown in FIG. 2 and a stereo input/output mode shown in FIG. 5.

Figure 2:
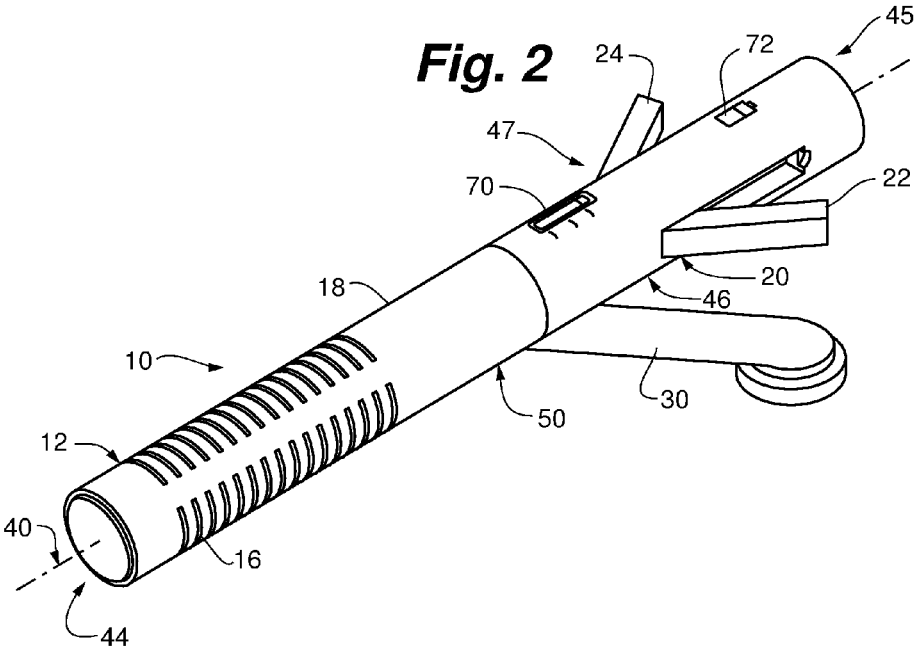
FIG. 2 is a perspective view of the embodiment shown in FIG. 1 and including a shock mount upon which the microphone is engaged.
Figure 3:
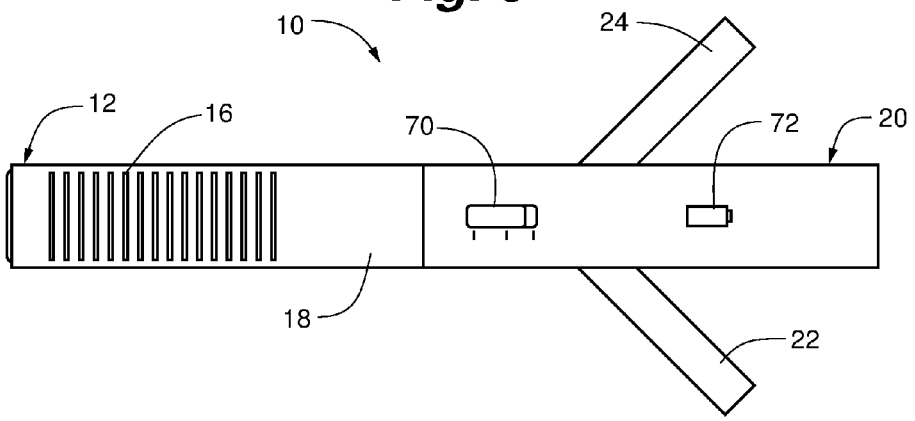
FIG. 3 is a top down view of the embodiment shown in FIG. 2.
Figure 4:
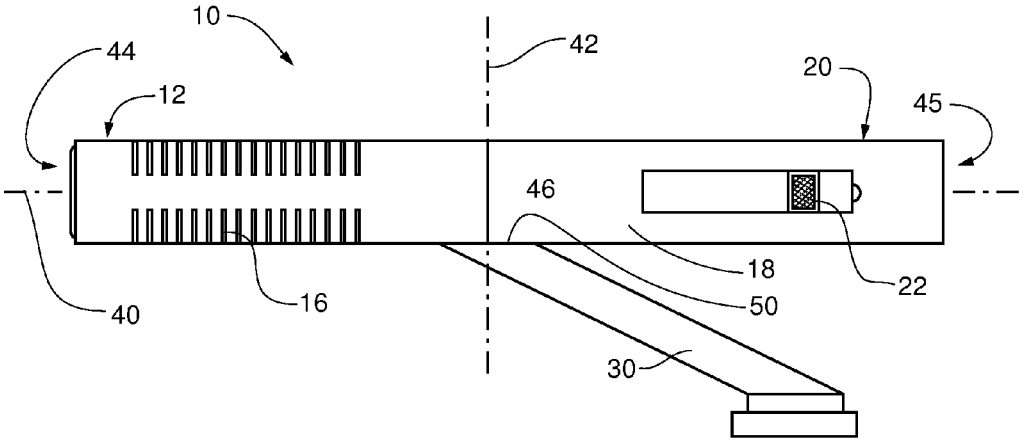
FIG. 4 is a side view of the embodiment shown in FIG. 2.

Turning to FIGS. 2 and 4, the assembly 10 includes a mount 30, such as a shock mount that may be part of a stand (tri-pod, boom pole, etc.) or other device for supporting the assembly when in use. Here the mount 30 also provides a frame of reference to explain how the assembly is switched between modes. As shown herein the assembly 10 has a longitudinal axis 40 and a rotational axis (axis of rotation) 42 (see FIGS. 4 and 5); as well as a front 44, a back or rear 45 and sides 46 and 47. Rotational axis 42 corresponds to the interface 50 between the mount 30 and the assembly 10. Interface 50 may be any sort of mechanism which allows the assembly 10 to rotate relative to the mount 30 about rotational axis 42, such as in the manner shown in FIG. 5.

When the assembly 10 is positioned in the mono position or mode such as is shown in FIGS. 2 and 4 the mono microphone 12 is active and picking up sound primarily from the front 44 of the microphone and along the longitudinal axis 40 (one for ordinary skill in the art will recognize an understand that additional sound may be captured by the mono microphone 12 from directions other than the front 44 (e.g. sides 46 and 47 and even from the rear 45 of the assembly) but that the mono microphone 12 is ideally configured to capture sound from directly in front 44 of the microphone and along the longitudinal axis 40.

Figure 5:
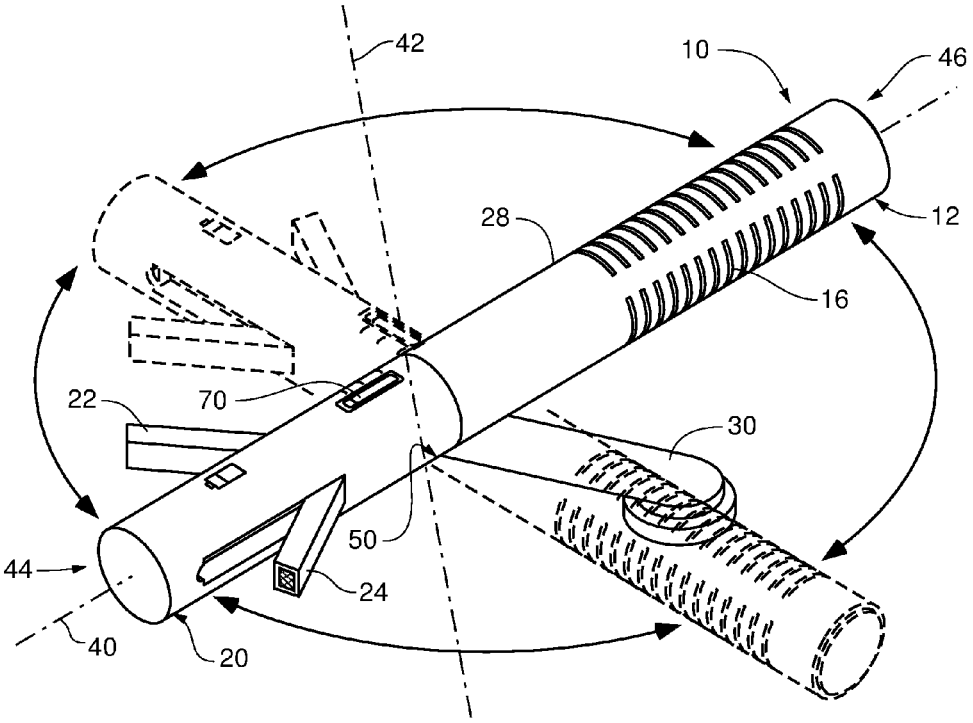
FIG. 5 is a perspective view of the embodiment shown in FIG. 2 and illustrating the ability of the microphone to rotate relative to the fixed position of the shock mount.

In order to "switch" from the mono configuration or mode, shown in FIGS. 2 and 4, a user simply rotates the assembly 10 180 degrees about the rotational axis 42 and interface 50 so that the mono microphone 12 is now pointed toward the rear 45 and the stereo microphone is directed toward the front 44 such as is depicted in FIG. 5.

The switching function provided by switch 60, may be captive (i.e. rotating the assembly 10 in a clockwise direction to switch the input/output mode from mono to stereo would require rotating of the assembly 10 in a counter-clockwise direction to switch the mode back from stereo to mono) or may be free (i.e. full 180 degree rotation of the assembly in a clockwise and/or counter-clockwise direction will provide the switching of input/output modes. That is to say: the direction of the rotation to activate the switch is irrelevant and not limited.).

Figure 6B:
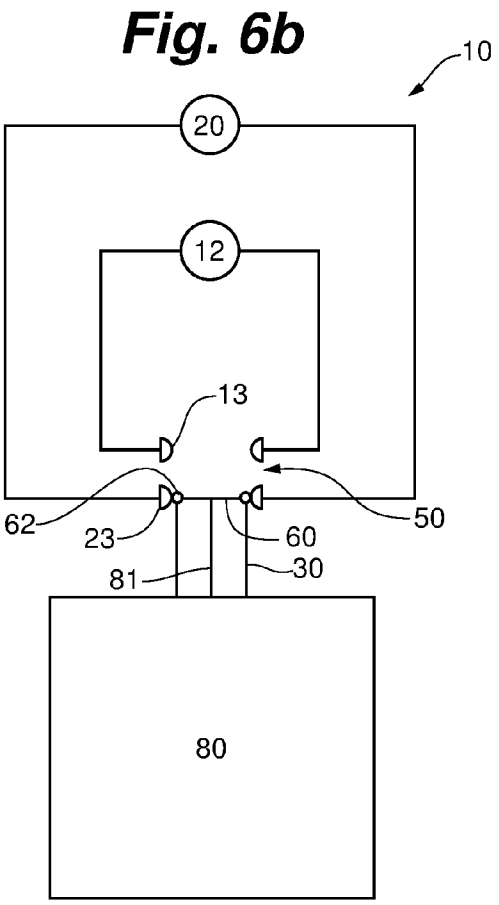
FIG. 6*b* is an electronic schematic diagram illustrating the mode select or switching function of the embodiment shown in FIG. 5 wherein the assembly is in a second or stereo input/output mode.
Figure 6A:
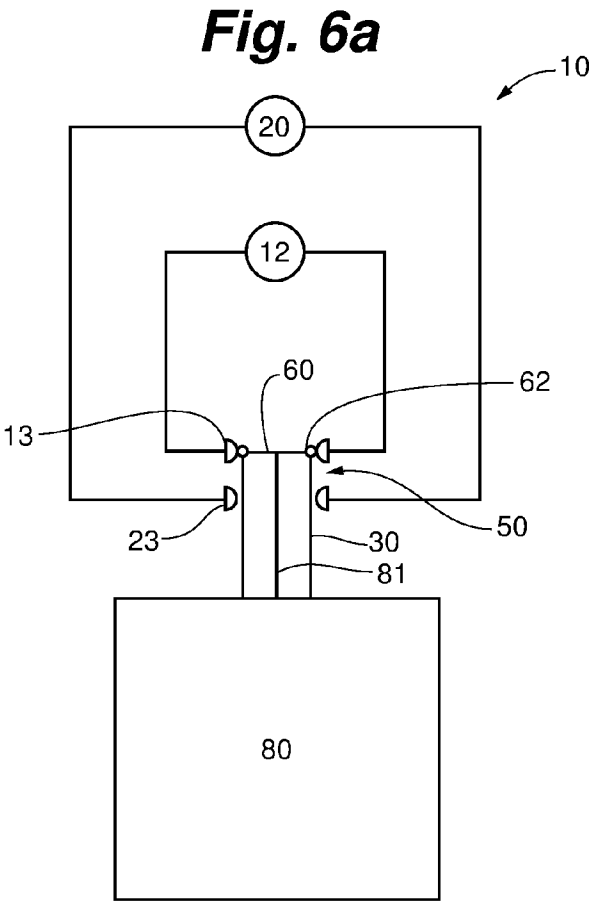
FIG. 6*a* is an electronic schematic diagram illustrating the mode select or switching function of the embodiment shown in FIG. 5 wherein the assembly is in a first or mono input/output mode.

The switch 60 and its function thereof is depicted in the schematic diagrams shown in FIGS. 6*a* and 6*b*. As depicted in FIG. 6*a*, when the assembly 10 is in the mono input/output mode shown in FIG. 2 the switch contacts 62 interface with the electrical contacts 13 of the mono microphone 12 thereby activating the mono input/output function of the assembly 10. In this position the mono input/out put mode is active and power is supplied to the mono microphone 12, while no power is supplied to the stereo microphone 20.

When the assembly 10 is rotated 180 degrees such as in the manner shown in FIG. 5, the switch contacts 62 are disengaged from the mono microphone contacts 13 and moved to interface the electrical contacts 23 of the stereo microphone 20, such as in the manner shown in FIG. 6*b*. When the assembly is positioned in this manner the switch deactivates the mono input/output mode and activates the stereo input/output mode by supplying power thereto.

Turning the assembly 10 180 degrees again will disengage the switch contacts 62 from the stereo microphone contacts 23 and re-engage the switch contacts 62 with the contacts 13 of the mono microphone 12. In this manner the modes of the assembly are easily switched between their activated and de-activated states (such that when one is "on" the other is "off") according to the position of the housing 18 (see FIG. 5) and switch 60 (see FIGS. 6*a* and 6*b*) relative to the shock mount 30; all without the need to manually remove and replace separate microphones as is the case with the prior art.

The particular post and contact arrangement shown in FIGS. 6*a* and 6*b* is merely one way that the switch 60 may function. In various embodiments the actual mechanism of the switch 60 may be any sort of rotary switch of suitable size and shape to extend from the assembly 10 and engage mount 30 at interface 50. In some embodiments, the switch may be integrated as part of the mount 30 and engage the assembly 10. In all embodiments however, it is required that the act of rotating the assembly 10 relative to the mount 30 actuates the switch to cause the assembly 10 to change from and between the mono input/output mode shown in FIG. 6*a* and the stereo input/output mode shown in FIG. 6*b*. Some examples of rotary switches and switch assemblies that may be utilized as switch 60 are described in U.S. Pat. Nos. 8,946,572; 7,880,101; 4,771,149; and 4,532,387 the entire contents of each of which being incorporated herein by reference.

Figure 7:
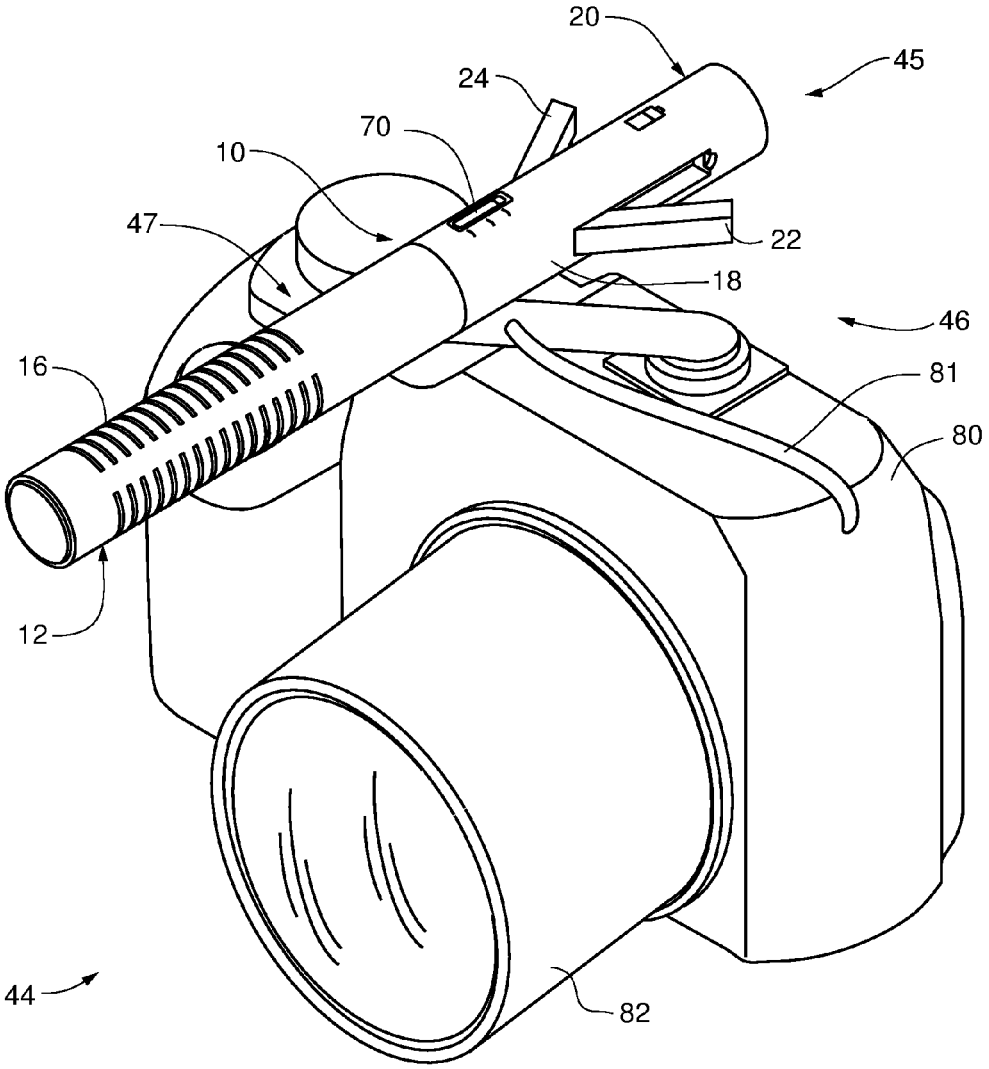
FIG. 7 is a perspective view of the embodiments shown in FIG. 2 wherein the microphone and shock mount is depicted engaged to a camera.

In the various embodiments, the audio signal output from the microphones 12 and 20 is transmitted electronically through the shock mount 30 to a recording device 80 such as a camera. The assembly 10 and/or mount may include a wire or cable 81, which is engaged to the camera 80. Though the cable 81 may be internal to the assembly 10 and mount 30 such as in FIGS. 6*a* and 6*b*; in some embodiments, an example of which is shown in FIG. 7, cable 81 is external to the mount 30 and camera 80.

Figure 8:
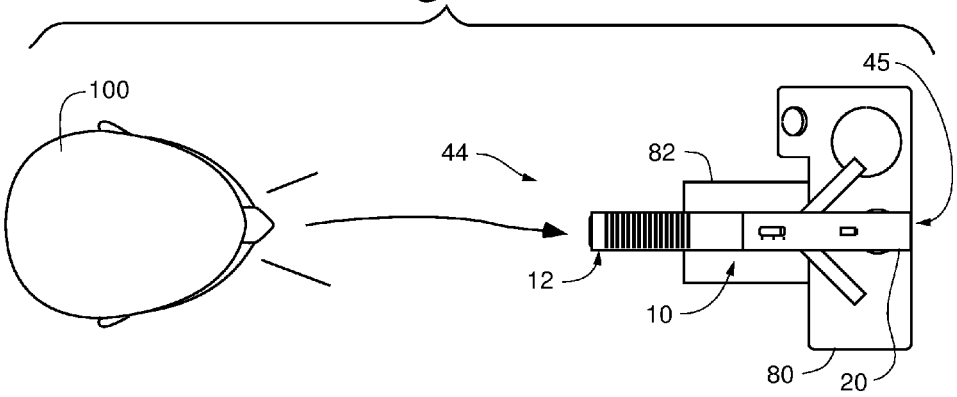
FIG. 8 is a top down view of the embodiment shown in FIG. 7 in a potential environment of use wherein the microphone is in a mono mode.
Figure 9:
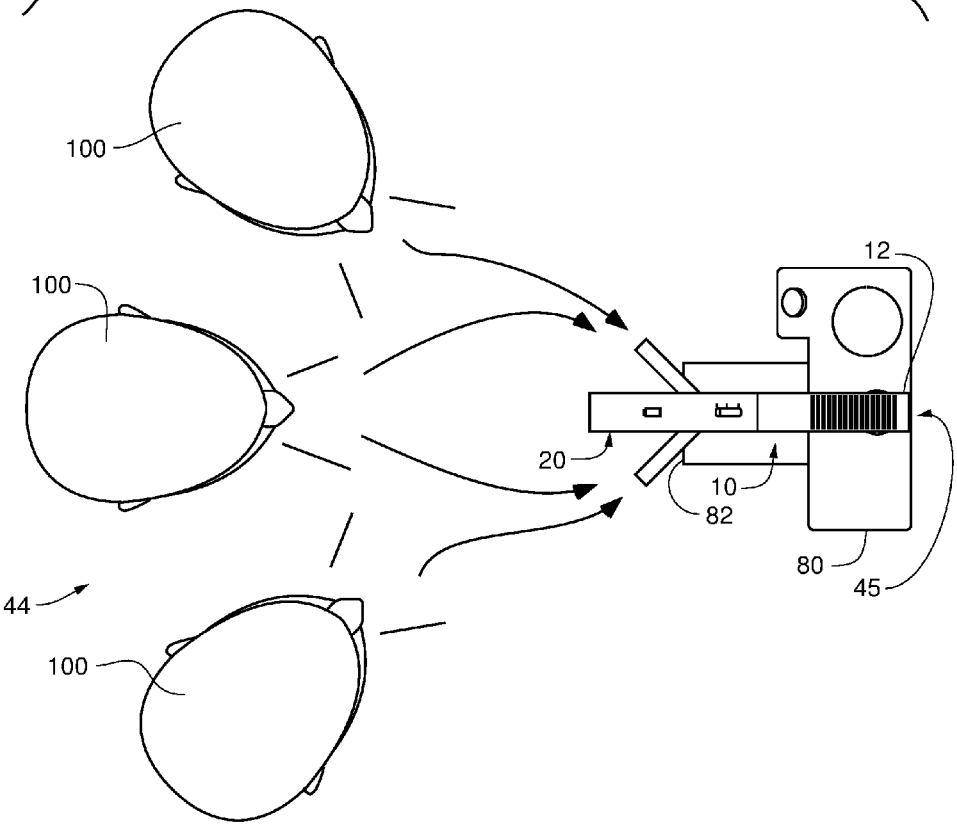
FIG. 9 is a top down view of the embodiment shown in FIG. 8 wherein the microphone is shown switched to a stereo mode.

In addition to being capable of being switched between the mono and stereo input/output modes described above, in some embodiments the assembly 10 includes a manual power control mechanism 70 as depicted in the various FIGS. 1-3, and 5. Control 70 may be a simple on/off toggle or may include additional positions and functions such as an intermediate "stand by" position wherein the assembly is not actively picking up or outputting sound until a camera or other device 80 electrically connected to the assembly 10 is activated, such as by the act of recording video or turning the camera 80 on. Examples of a camera 80 that may be electrically and mechanically coupled in the assembly 10 and mount 30 is shown in FIGS. 7-9.

In some embodiments, stereo microphone 20 employs actuatable inputs 22 and 24 which may be contained/retained within the tubular profile of the assembly 10 such as in the manner shown in FIG. 1 and which are deployable outwardly therefrom, such as in the manner shown in FIG. 2. Deployment of the inputs 22 and 24 may be by mechanical or electrical actuation via control 70, or may be a function of switching the mode of the assembly 10 from mono to stereo by rotating/switching the assembly 10 relative to the mount 30 in the manner described above and shown in FIG. 5.

As indicated in FIGS. 1-4, in some embodiments of the assembly 10, the microphones 12 and 20 are powered by an internal power source such as a battery or batteries (not shown). The amount of charge or a "time remaining" for use indicator 72 may be positioned on an external surface of the assembly 10 to indicate that the assembly has sufficient power for use and/or for how long. In at lease one embodiment the indicator 72 is a color coded indicator having three color states corresponding to available charge (e.g. green/yellow/red corresponding to a full charge/partial charge/low charge).

In some embodiments the assembly 10 does not contain an internal power source, is configured to be powered by an associated device such as a camera 80 (see FIG. 7 discussed in greater detail below) or by phantom power (see for example: https://en.wikipedia.org/wiki/Phantom_power) transmitted to the assembly by a microphone cable in communication with assembly 10 via switch 60.

Turning now to the embodiment shown in FIGS. 7-9, here the assembly 10 is shown engaged to a camera 80 via the shock mount 30. The mount 30 may have any sort of engagement mechanism suitable for connecting the camera 80 and mount 30. Some example of suitable engagement mechanisms are hot shoe and cold shoe assemblies, rail slides, etc.

In FIG. 7 the assembly is shown in the mono mode, wherein the mono microphone 12 is pointed in the same direction as the lens 82 of the camera 80. In some embodiments the engagement of the assembly 10 and mount 30 to the camera 80 is a mechanical engagement as well as an electrical engagement, such that the sound detected and input into the microphones 12 and/or 20 is transmitted to the camera 80 and recorded by its recording mechanism.

In some embodiments by engaging the assembly 10 (via the mount 30) to a camera 80 the functionality of the assembly may be modified beyond what has been described above. For example, in some embodiments wherein the assembly includes an internal power source, the assembly 10 may include a mechanism that detects the engagement of the assembly 10 to the camera 30 and thereby activates a bypass such that the microphones 12 and 20 are supplied power from the power source of the camera 80 rather than by the internal power source of the assembly 10. Alternatively, the controller 70 may include a mechanism for switching the power source for the microphones 12 and 20 from the assembly 10 to that of the camera 80.

As mentioned above, the use of the particular sound detecting modes (mono vs stereo) of the assembly 10 may vary depending on the acoustic environment surrounding the assembly. In FIGS. 8 and 9 two potential environments are depicted to represent conditions wherein someone filming with a camera 80 might want one recording mode (mono in the case of FIG. 8) or the other (stereo in the case of FIG. 9) to capture the sound via assembly 10 corresponding to the images being recorded by the camera 80.

Starting with FIG. 8, here a single audio source 100 is shown. In this circumstance, the mono mode of the assembly 10 is utilized. In this instance, the mono or shotgun microphone 12 is longitudinally parallel with the direction of the camera lens 82 to ensure that sound emitted from the source 100 is captured along the entire length of the microphone 12 so as to maximize the capture of sound emitted by the source 100 and minimize any ambient or undesired background noise.

Turning to FIG. 9, here multiple audio sources 100 are present and it may not be possible to longitudinally align the camera 80 and assembly 10 with all of the sources 100. In such a circumstance the assembly 10 is rotated in the manner shown in FIG. 5 to switch the audio input/output mode to stereo. Here the stereo microphone 20 is better capable of receiving and outputting quality sound from a greater range of angles than the mono microphone 12 shown in FIG. 8.

In at least one embodiment the assembly 10 is constructed and/or positioned via mount 30 to ensure that the back of each microphone is flush with the back of the camera 80 when in the respectively activated position (mono microphone 12 in the case of FIG. 8 and stereo microphone 20 in the case of FIG. 9).

Due to the ease of use and function that the assembly 10 provides to the operator (not shown) of the camera 80, as recording circumstances change (such as when audio sources 100 move, are added or otherwise varied) the assembly 10 is simply rotated by the user so as to easily to change input/output modes and thus provide the video being recorded by the camera 80 with audio tracks that best fit the circumstances of the recording environment.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A multi-mode microphone assembly comprising:

a mono microphone and a stereo microphone, a rotary switch, the mono microphone, the stereo microphone and the rotary switch being contained within a housing, the mono microphone having a mono input/output mode and the stereo microphone having a stereo input/output mode, wherein only one input/output mode is active depending on the position of the rotary switch within the housing, such that when the rotary switch is in a first position only the mono input/output mode is activated and when the rotary switch is in a second position the mono input/output mode is deactivated and the stereo input/output mode is activated;

the first position of the rotary switch corresponding to a first position of the housing, the second position of the rotary switch corresponding to a second position of the housing, wherein the second position and the first position are offset 180 degrees from one another.

2. The assembly of claim 1, further comprising a mount, the mount engaged to the housing at an interface.

3. The assembly of claim 2, further comprising an axis of rotation extending through the interface of the housing and the mount, the housing be rotatable relative to the mount about the axis of rotation.

4. The assembly of claim 3, wherein the first position of the rotary switch and the first position of the housing, and the second position of the rotary switch and the second position of the housing are relative to the mount.

5. The assembly of claim 4, further comprising a camera, the mount extending between the housing and the camera.

6. The assembly of claim 5, wherein the camera is in electrical communication with the mono microphone, the stereo microphone and the rotary switch.

7. The assembly of claim 1, further comprising a power supply, the power supply providing power to the mono microphone and the stereo microphone for their operation.

8. The assembly of claim 7, wherein the power supply is at least one battery contained within the housing.

9. The assembly of claim 8, further comprising a power indicator, the power indicator being positioned on the housing, the power indicator being in electrical communication with the at least one battery, the power indicator providing a visual display of the current and/or remaining power level of the at least one battery.

10. The assembly of claim 7, further comprising a control mechanism, the control mechanism being positioned on the housing, the control mechanism including an "on" position and an "off" position, wherein in the "on" position power is supplied from the power supply to the mono microphone or the stereo microphone depending on the position of the rotary switch.

11. The assembly of claim 1 wherein the stereo microphone comprises a first input and a second input, the first input and the second input being positioned on opposite sides of the housing.

* * * * *